US009357822B2

(12) United States Patent
Ge

(10) Patent No.: US 9,357,822 B2
(45) Date of Patent: Jun. 7, 2016

(54) PROTECTION CASE FOR ELECTRONIC DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Hai-Qian Ge, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 246 days.

(21) Appl. No.: 14/138,171

(22) Filed: Dec. 23, 2013

(65) Prior Publication Data

US 2014/0183064 A1 Jul. 3, 2014

(30) Foreign Application Priority Data

Dec. 29, 2012 (CN) ..... 2012 1 0588925

(51) Int. Cl.

| | |
|---|---|
| ***B65D 85/00*** | (2006.01) |
| ***B65D 81/02*** | (2006.01) |
| ***A45C 11/00*** | (2006.01) |
| *A45C 13/02* | (2006.01) |

(52) U.S. Cl.

CPC ..... *A45C 11/00* (2013.01); *A45C 13/021* (2013.01); *A45C 2011/003* (2013.01); *A45C 2013/025* (2013.01)

(58) Field of Classification Search

CPC ..... A45C 11/00; A45C 13/021; A45C 2011/003; A45C 2013/025

USPC ..... 206/305, 320, 522, 37–39, 591–594; 455/575.1, 575.8; 361/679.55, 679.56

See application file for complete search history.

(56) References Cited

U.S. PATENT DOCUMENTS

| | | | | |
|---|---|---|---|---|
| 5,175,876 | A * | 12/1992 | Villacis Mendoza | H01H 9/0242 206/320 |
| 5,622,262 | A * | 4/1997 | Sadow | A45C 13/021 206/320 |
| 8,584,847 | B2 * | 11/2013 | Tages | G06F 1/1633 206/320 |
| 8,757,374 | B1 * | 6/2014 | Kaiser | F16M 11/10 206/320 |
| 9,154,593 | B1 * | 10/2015 | Meldner | H04M 1/026 |
| 2005/0284791 | A1 * | 12/2005 | Sadow | B65D 81/052 206/522 |
| 2011/0272305 | A1 * | 11/2011 | Lee | A45C 5/03 206/320 |
| 2012/0168009 | A1 * | 7/2012 | Chen | G09F 9/301 361/749 |
| 2013/0126533 | A1 * | 5/2013 | Klosky | B65D 25/00 220/560 |

* cited by examiner

*Primary Examiner* — Luan K Bui

(74) *Attorney, Agent, or Firm* — Novak Druce Connolly Bove + Quigg LLP

(57) ABSTRACT

A protecting case for protecting an electronic device includes a hollow main body. The electronic device is received in the main body. The main body is filled with gas having a density less than a density of air, to make the main body and the electronic device suspend in air while received in the main body.

14 Claims, 5 Drawing Sheets

PROTECTION CASE FOR ELECTRONIC DEVICE

TECHNICAL FIELD

The disclosure generally relates to cases, and particularly, to a protection case for an electronic device.

DESCRIPTION OF RELATED ART

Generally, handheld electronic devices do not have a stand for supporting the electronic device. A user has to hold the electronic device in a certain desired orientation. However, to hold the electronic device for a long time can be uncomfortable.

Therefore, it is desirable to provide a means which can overcome the above-mentioned problems.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

Figure 1:
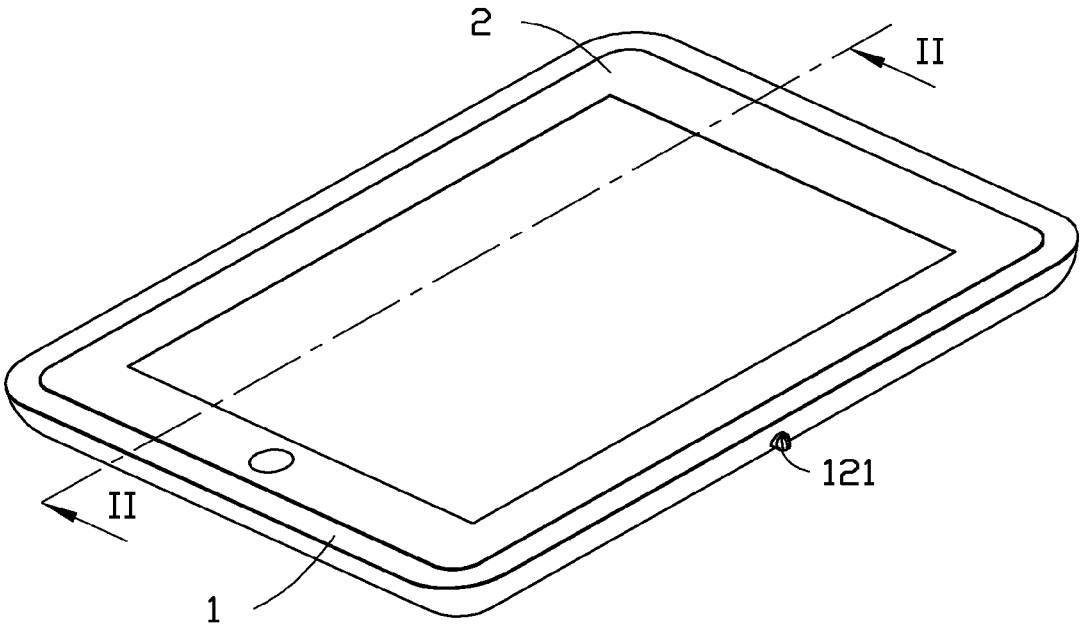
FIG. 1 is an isometric, assembled view of a protection case and an electronic device in accordance with an exemplary embodiment.
Figure 2:
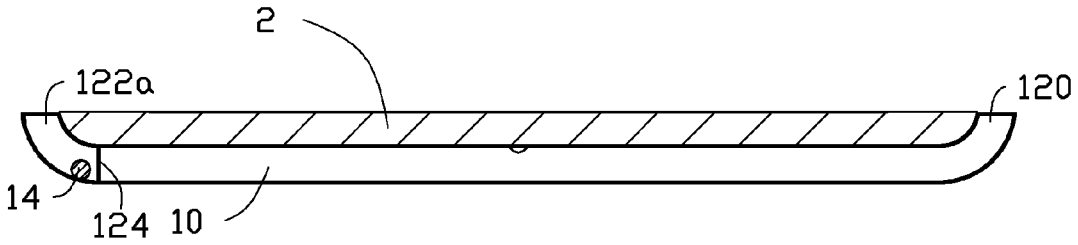
FIG. 2 is an isometric, cross-sectional view of the protection case of FIG. 1, taken along line II-II.
Figure 3:
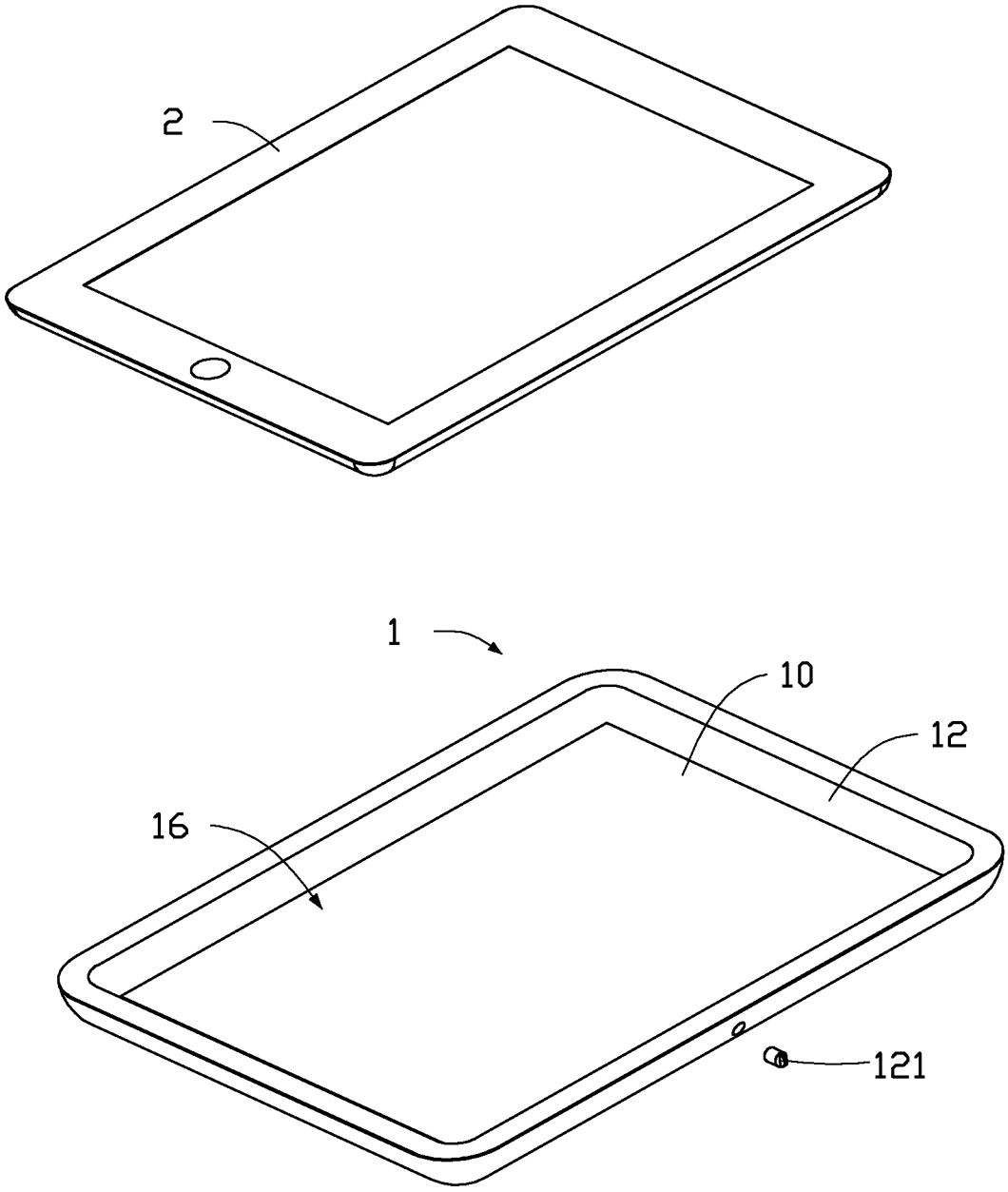
FIG. 3 is an isometric, exploded view of the protection case of FIG. 1.

In FIGS. 1-3, a protection case 1 for an electronic device 2 in accordance with an exemplary embodiment includes a baseboard 10, a sidewall 12, and a number of adjusting balls 14. The sidewall 12 extends from a periphery of the baseboard 10. The adjusting balls 14 are received inside the sidewall 12. The baseboard 10 defines a receiving space 16 in cooperation with the sidewall 12 to receive the electronic device 2. The baseboard 10 and the sidewall 12 are hollow. The baseboard 10 and a part of the sidewall 12 are filled with gas having a density less than air. Thus, the protection case 1 with received the electronic device 2 is suspended in the air via a buoyancy generated by a difference in density between the gas and the air. The adjusting balls 14 roll in the sidewall 12 along different directions to adjust an orientation of the protection case 1. In this embodiment, the electronic device 2 is a mobile intelligent terminal, such as, a smart phone or a tablet computer.

Figure 4:
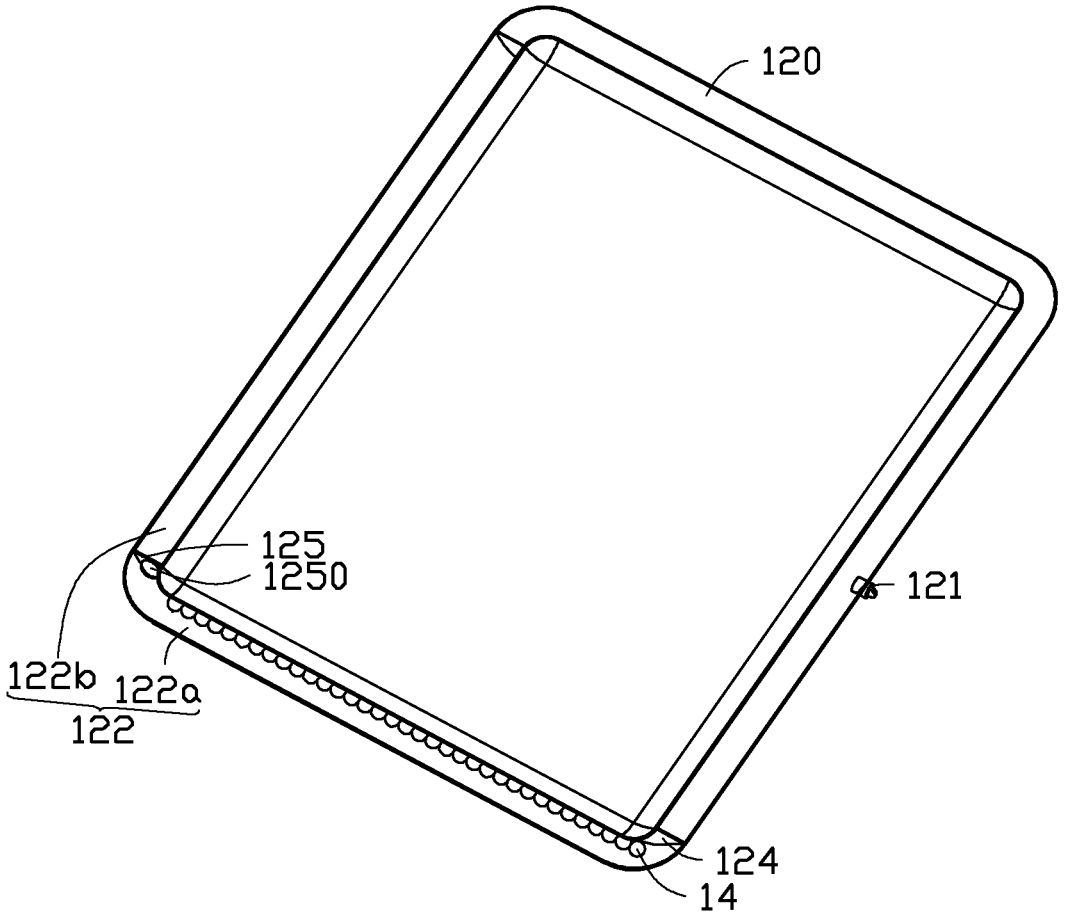
FIG. 4 is a cutaway view of the protection case of FIG. 3, showing a number of adjusting balls in a first adjustable sidewall of the protection case.

FIGS. 3 and 4 show that the baseboard 10 has a predetermined thickness and is hollow inside to accommodate the gas. The sidewall 12 extends from the periphery of the baseboard 10 towards a same direction. The sidewall 12 includes a filling sidewall 120 and an adjustable sidewall 122. The filling sidewall 120 communicates with the baseboard 10. The filling sidewall 120 includes a valve 121 to expend the gas. The adjustable sidewall 122 is isolated from the baseboard 10 by a barrier 124. The adjustable sidewall 122 includes at least two parts 122*a*, 122*b* correspondingly extending along different directions and a baffle plate 125 set at a turning corner between two adjacent parts 122*a*, 122*b* of the adjustable sidewall 122. The adjusting balls 14 are received in the adjustable sidewall 122 and roll along the adjustable sidewall 122. The adjustable sidewall 122 defines a through hole 1250 in the baffle plate 125. The adjusting balls 14 are transferred between the different parts 122*a*, 122*b* of the adjustable sidewall 122 by passing through the through hole 1250. Thus, a center of gravity of the protection case 1 is adjusted according to a distribution of the number of the adjusting balls 14 in the different parts 122*a*, 122*b* of the adjustable sidewall 122, and the suspending protection case 1 can allow for different positionings.

In this embodiment, the baseboard 10 is rectangular. The different parts 122*a*, 122*b* of the adjustable sidewall 122 are a first adjustable sidewall 122*a* extending along a width of the protection case 1 and a second adjustable sidewall 122*b* extending along a length of the protection case 1. The first adjustable sidewall 122*a* is directly adjacent to the second adjustable sidewall 122*b*. The adjustable sidewall 122 is not inflated with the gas. In the other embodiment, the adjustable sidewall 122 can be filled with the gas.

Figure 5:
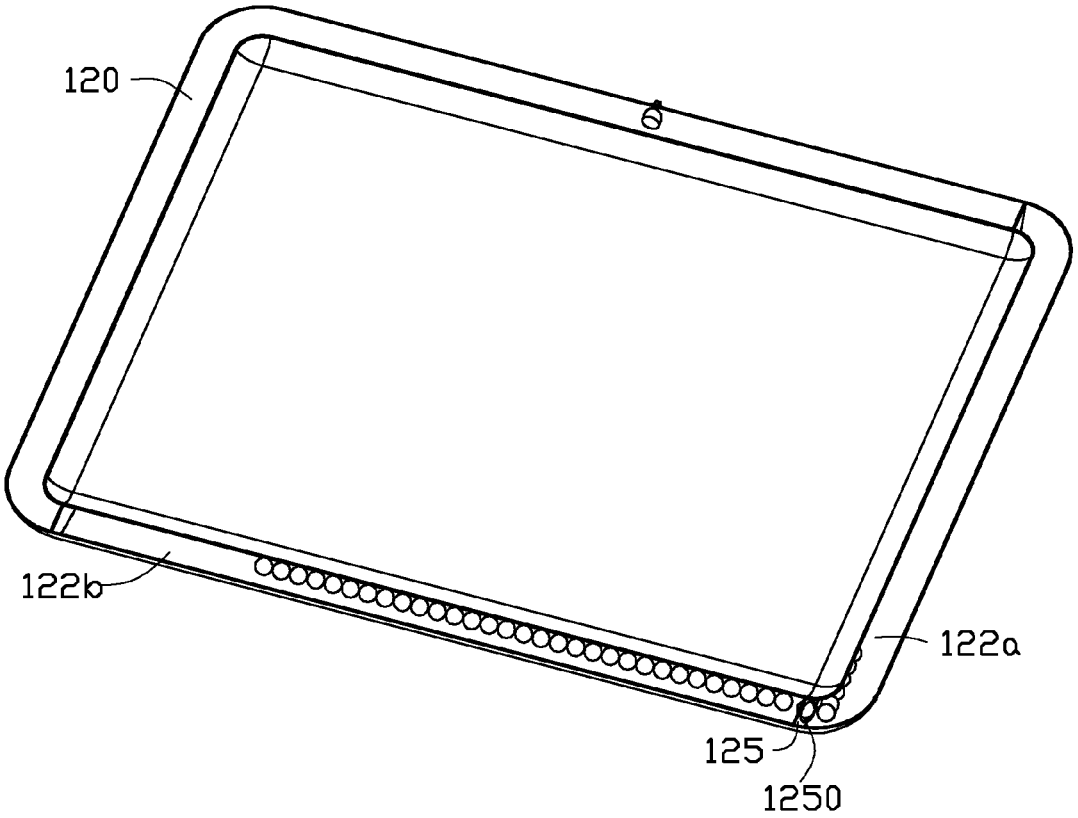
FIG. 5 is similar to FIG. 4, but showing the adjusting balls in a second adjustable sidewall of the protection case.

FIGS. 4 and 5 show that in use, the electronic device 2 is received in the receiving space 16 of the protection case 1. The gas is filled in the filling sidewall 120 and the baseboard 10 via the valve 121. In this embodiment, the gas is hydrogen. The buoyancy forced in the protection case 1 filled with the gas is substantially equal to a summation of gravity of the protection case 1. The electronic device 2, and the adjusting balls 14, are suspended in the air in the protection case 1. The adjusting balls 14 roll along the adjustable sidewall 122 when the protection case 1 is rotated adjusting the distribution of the adjusting balls 14 in the adjustable sidewall 122. Thus, the posture of the suspending protection case 1 is changed according to the distribution of the number of the adjusting balls 14 in the adjustable sidewall 122. For example, when the adjusting balls 14 stay in the first adjustable sidewall 122*a*, the protection case 1 is inclined with the first adjustable sidewall 122*a* facing downwards and the filling sidewall 120 parallel opposite to the first adjustable sidewall 122*a* facing upwards. When the adjusting balls 14 stay in the second adjustable sidewall 122*b*, the protection case 1 is inclinded with the second adjustable sidewall 122*b* facing downwards and the filling sidewall 120 parallel opposite to the second adjustable sidewall 122*b*.

The hollow protection case 1 is inflated with gas lighter than air gas to hold the electronic device 2 suspended in the air, which relieves fatigue of holding the electronic device 2 by hand for a long time.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments.

What is claimed is:

1. A protection case for an electronic device, comprising:

a hollow baseboard; and a hollow sidewall extending from a periphery of the baseboard towards a same direction and defining a receiving space in cooperation with the baseboard to receive the electronic device;

wherein the baseboard and at least a part of the sidewall is filled with gas having a density less than a density of air; the sidewall comprises a filling sidewall communicating with the baseboard and an adjustable sidewall isolated from the baseboard via a barrier.

2. The protection case of claim 1, wherein the filling sidewall comprises a valve, and the gas is filled in the filling sidewall via the valve.

3. The protection case of claim 1, further comprising a plurality of adjusting balls received in the adjustable sidewall and rolling along the adjustable sidewall.

4. The protection case of claim 3, wherein the adjustable sidewall comprises at least two adjacent parts correspondingly extending along different directions and a baffle plate set at a turning corner between the at least two adjacent parts.

5. The protection case of claim 4, wherein the adjustable sidewall defines a through hole in the baffle plate, and the adjusting balls are transferred between the at least two parts of the adjustable sidewall by passing through the through hole.

6. The protection case of claim 1, wherein the gas is hydrogen.

7. A case for an electronic device, comprising:

a hollow main body covering at least a portion of the electronic device; and a plurality of adjusting balls received in the main body and configured to rotate along a rotation of the case;

wherein the main body is filled with gas having a density less than a density of air so that the main body and the electronic device received in the main body are suspend in the air via a buoyancy generated by a difference in density between the gas and the air.

8. The case of claim 7, wherein the main body comprises a hollow baseboard and a hollow sidewall extending from a periphery of the baseboard, and the electronic device is accommodated in a receiving space defined by the baseboard in cooperation with the sidewall.

9. The case of claim 8, wherein the sidewall comprises a filling sidewall communicating with the baseboard and an adjustable sidewall isolated from the baseboard via a barrier.

10. The case of claim 9, wherein the filling sidewall comprises a valve, and the gas is filled in the filling sidewall via the valve.

11. The case of claim 9, the adjusting balls are received in the adjustable sidewall and rolls along the adjustable sidewall.

12. The case of claim 9, wherein the adjustable sidewall comprises at least two adjacent parts correspondingly extending along different directions and a baffle plate set at a turning corner between the at least two adjacent parts.

13. The case of claim 12, wherein the adjustable sidewall defines a through hole in the baffle plate, and the adjusting balls are transferred between the at least two parts of the adjustable sidewall by passing through the through hole.

14. The case of claim 7, wherein the gas is hydrogen.

* * * * *